US006298141B1

(12) United States Patent
Hickman

(10) Patent No.: US 6,298,141 B1
(45) Date of Patent: Oct. 2, 2001

(54) METHOD AND APPARATUS FOR AUDIO BASS ENHANCEMENT IN A ELECTRONIC DEVICE

(75) Inventor: Scott N Hickman, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/962,980

(22) Filed: Oct. 30, 1997

(51) Int. Cl.[7] ..... H04R 1/02

(52) U.S. Cl. ..... 381/333; 381/396; 381/412; 381/388; 310/13

(58) Field of Search ..... 310/28, 14, 13; 381/24, 117, 90, 306, 158, 396, 412, 333, 388; 318/138

(56) References Cited

U.S. PATENT DOCUMENTS 4,504,704 * 3/1985 Ohyaba et al. ..... 381/117
4,883,977 * 11/1989 Regan ..... 318/138
4,912,343 * 3/1990 Stuart ..... 310/14
5,115,474 * 5/1992 Tsuchiya et al. ..... 381/158
5,424,592 6/1995 Bluen et al ..... 310/28
5,528,697 * 6/1996 Saito ..... 381/396
5,610,992 3/1997 Hickman ..... 381/188
5,668,882 9/1997 Hickman et al. ..... 381/24
5,732,140 * 3/1998 Thayer ..... 381/90
5,809,157 * 9/1998 Grumazescu ..... 381/412
5,870,485 * 2/1999 Lundgren et al. ..... 381/306
5,894,263 * 4/1999 Shimakawa et al. ..... 381/192
5,930,376 * 7/1999 Markow et al. ..... 381/333

* cited by examiner

*Primary Examiner*—Forester W Isen
*Assistant Examiner*—Brian Pendleton

(57) ABSTRACT

An electronic device has a shell with an interior, an exterior and a resonant frequency of, for example, 100 Hz. A transducer located in the interior of the shell is operatively coupled to control circuitry. The control circuitry is capable of sending a low frequency audio signal to the transducer which utilizes an electromagnetic force as a source of vibration excitation to cause the shell to vibrate around the resonant frequency of the shell. A low frequency sound is produced by the vibration of the shell.

8 Claims, 5 Drawing Sheets

METHOD AND APPARATUS FOR AUDIO BASS ENHANCEMENT IN A ELECTRONIC DEVICE

BACKGROUND OF THE INVENTION

This invention relates to the electronics circuitry field. More particularly, this invention is for the enhancement of audio bass in an electronic device.

Portable electronic devices, such as portable personal computers, have decreased dramatically in size in the last few years. Early portable computers weighed over twenty pounds and more realistically resembled a desktop computer with a handle—requiring a reasonable amount of strength to carry them. In contrast, today's laptop and sub-notebook computers can weigh less than three pounds, can easily fit in a briefcase and are truly portable. While the decrease in size of portable personal computers has been a boon to business travelers, it has not been without its problems.

One such problem is that as a computer or other electronic device gets smaller, many of the components contained in the computer or other electronic device must also get smaller. Examples of components that have shrunk along with the device is the circuitry, the hard disk storage, and the speaker. The reduction in the size of the circuitry and the hard disk storage has not been much of a problem, since technological advancements in these areas has allowed equal or better functionality to be present in smaller sizes than what was previously available in the larger sizes.

The reduction in the size of the speaker, on the other hand, has caused more severe problems. As the speaker gets smaller, the maximum power the speaker can handle also gets smaller, thereby reducing the quality of the sound the speaker can produce. In addition, the low frequency response of small speakers must be traded off against the maximum power the speaker can handle because of the physical movement of the speaker's coil at low frequencies. The low power and poor low frequency response of small speakers is wholly unacceptable in today's portable computers and other electronic devices where sound is important, such as when running today's sound intensive multimedia applications.

Although improvements have been made to the speaker quality in portable computers, the low frequencies required to give the user a full audio spectrum is not achievable with the speaker size limitations imposed by the limited space available for components in portable computers.

SUMMARY OF THE INVENTION

An electronic device has a shell with an interior, an exterior and a resonant frequency of, for example, 100 Hz. A transducer located in the interior of the shell is operatively coupled to control circuitry. The control circuitry is capable of sending a low frequency audio signal to the transducer which utilizes an electromagnetic force as a source of vibration excitation to cause the shell to vibrate around the resonant frequency of the shell. A low frequency sound is produced by the vibration of the shell.

DETAILED DESCRIPTION OF THE PREFERRED AND ALTERNATE EMBODIMENTS

Figure 1:
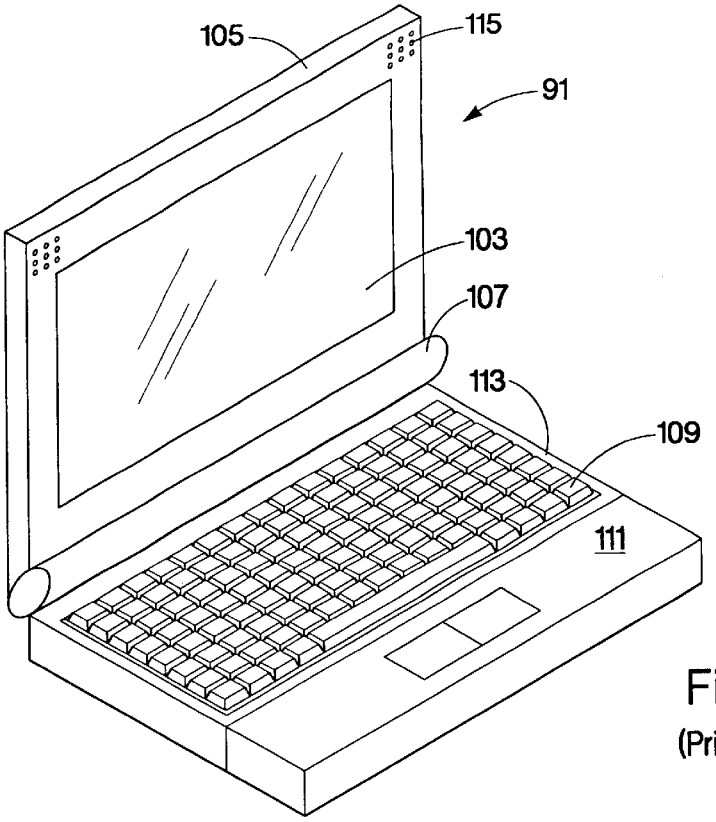
Fig. 1 (Prior Art)
FIG. 1 is a portable computer known in the prior art.

FIG. 1 shows prior art portable computer 91, which has display 103 mounted in upper housing 105 of portable computer 91, utilizing hinge 107 to attach upper housing 105 to shell 113 which houses keyboard 109 and palmrest 111. Also shown is one configuration of existing speakers 115. While speakers 115 do an acceptable job reproducing midrange and high frequency sounds, they do a poor job reproducing low frequency sounds, such as sounds below 150 Hz.

Figure 2:
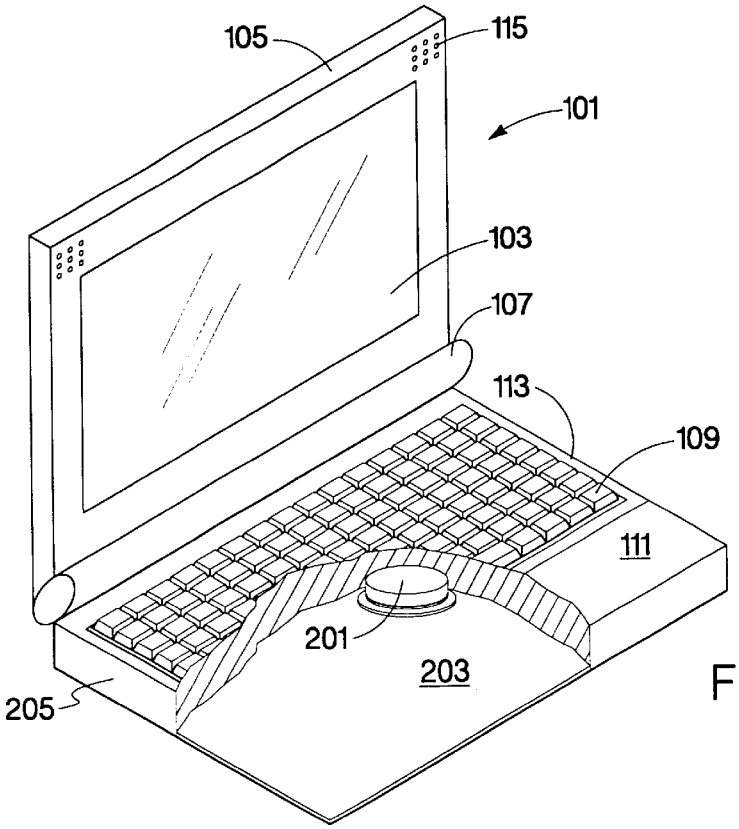
FIG. 2 is an electronic device in the preferred embodiment of the invention.

FIG. 2 shows electronic device 101 of the preferred embodiment. In the preferred embodiment, electronic device 101 is a portable computer, although alternate embodiments have been contemplated where electronic device 101 is a hand-held computer game, portable television or a speaker phone. On the inner surface 203 of shell 113 is affixed a transducer 201 that will be the source of an electromagnetic force utilized to create vibration in shell 113 for the enhancement of the audio bass in electronic device 101. As exterior surface 205 of shell 113 vibrates around the resonant frequency of shell 113 of, for example 100 Hz, low frequency sound is produced. In effect, transducer 201 and exterior surface 205 of shell 113 becomes a low frequency speaker.

Figure 3:
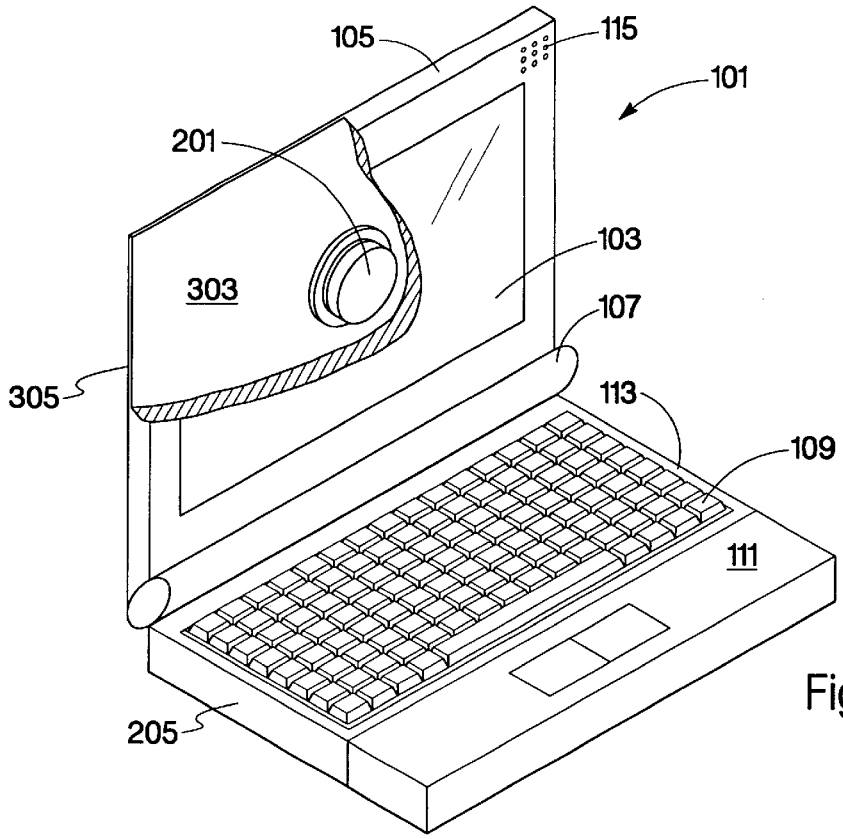
FIG. 3 is an electronic device in an alternate embodiment of the invention.

FIG. 3 shows an alternate embodiment of electronic device 101. Transducer 201 is shown in the cutaway section of upper housing 105 affixed to upper housing inner surface 303 and behind display 103. In this embodiment, transducer 201 will cause facing surface 305 of upper housing 105 to vibrate, thereby producing low frequency sound.

Figure 4:
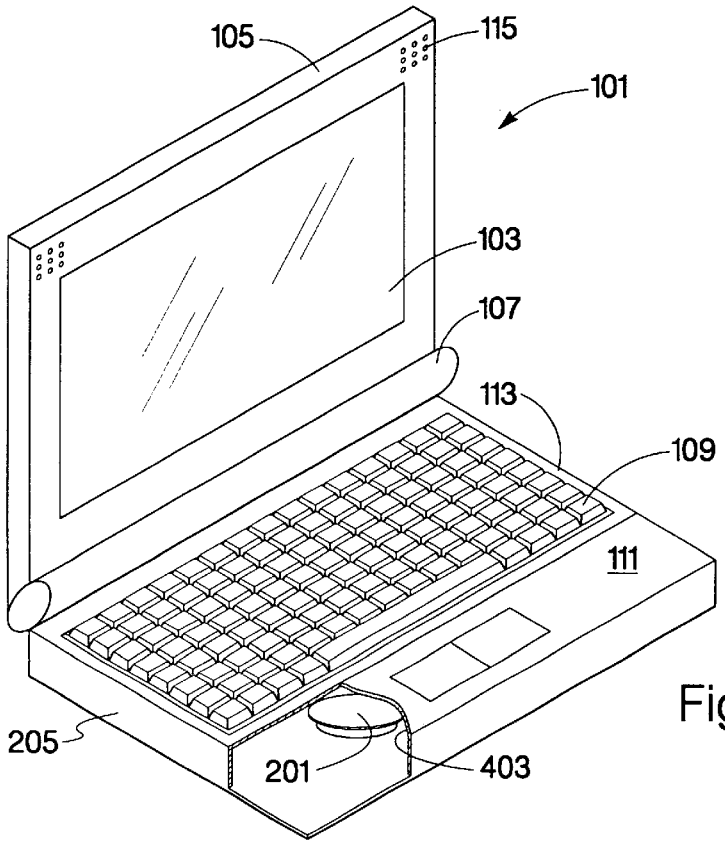
FIG. 4 is an electronic device in another alternate embodiment of the invention.

FIG. 4 shows another alternate embodiment of electronic device 101 wherein transducer 201 is mounted on interior upper surface 403 of palmrest 111. This embodiment will give a tactile feeling of the low frequency sounds to the user through the vibrations felt in palmrest 111. Those skilled in the art will appreciate that transducer 201 can be mounted in other locations and still fall within the spirit and scope of the invention.

An embodiment has been contemplated where multiple transducers have been utilized, each of which have the same or different low frequency responses. If the low frequency response of these transducers are different, the summation of the transducers can widen the low frequency response heard and felt by the user. Channeling the signal from control circuitry 810 (FIG. 5) through different low pass filters 820 (FIG. 5), in addition to altering the design characteristics of the transducers would allow selection of the desired low frequency bands. Those skilled in the art can appreciate that any combination of the embodiments depicted in FIG. 2, FIG. 3, or FIG. 4 would accomplish this task.

Figure 5:
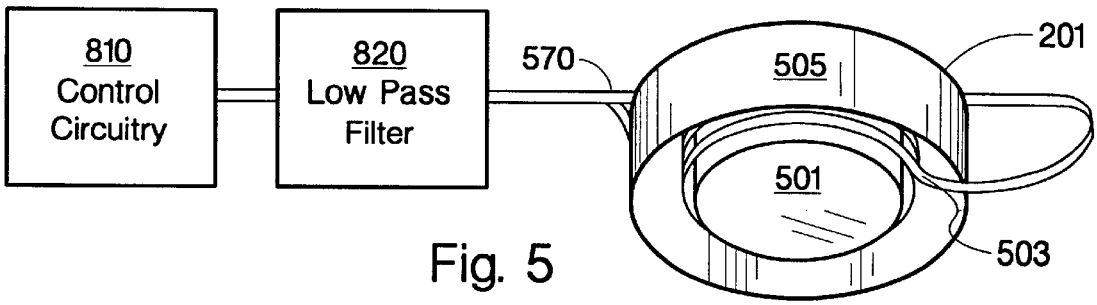
FIG. 5 is a transducer in the preferred embodiment of the invention.

FIG. 5 shows transducer 201 of the preferred embodiment. Transducer 201 contains can 505, permanent magnet 501 rigidly attached inside can 505, and alternate current carrying coils 503 wound around permanent magnet 501. Control circuitry interconnects 507 are shown extending through can 505, into low pass filter 820 and into control circuitry 810.

Figure 6:
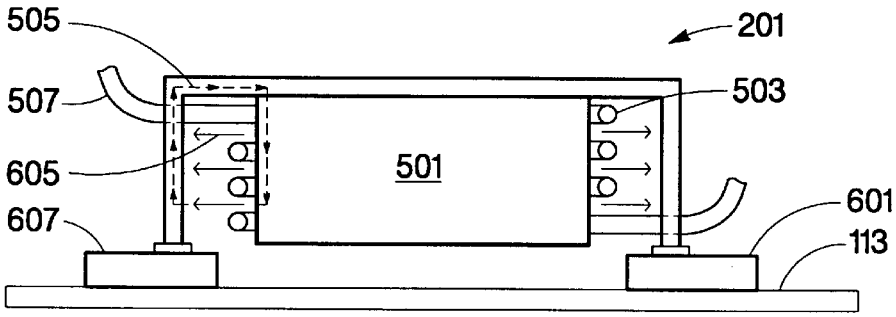
FIG. 6 is a cross-sectional view of the transducer of FIG. 5.

FIG. 6 shows a center cross-sectional view of FIG. 5. Can 505 is affixed to compliant material 601 interposed between can 505 and electronic device shell 113. Adhesive 607 is interposed between can 505 and compliant material 601. Compliant material 601 is attached to electronic device shell 113. A low frequency audio signal is applied to control circuitry interconnect 507 by control circuitry 810 (FIG. 5).

Magnet 501 generates radial magnetic field 605. Magnetic field 605 continues through can 505 and returns into permanent magnet 501 in a circular path, as is shown in FIG. 6. The alternating current applied to coil 503 through control circuitry interconnect 507 generates a field which interacts with magnetic field 605, causing permanent magnet 501 to oscillate up and down in a manner similar to a voice coil device. This oscillation causes the entire transducer to move the distance allowed by the thickness of compliant material 601, creating a vibration of electronic device shell 113 around the resonant frequency of electronic device shell 113. The vibration of electronic device shell 113 creates sound waves that allow the electronic device shell 113 to function as a low frequency speaker. This vibrating action will give both a tactile and an audible feeling of the low frequency sounds emitted from electronic device 101.

The preferred material for electronic device shell 113 is a material such as plastic, although an alternate embodiment has been contemplated where metal is used. The preferred material for compliant material 601 is a foam elastimer. The specific choice of foam would be chosen for the compliance level that would allow the electronic device shell and transducer to have one fundamental resonance. If multiple transducers were used, alternate choices of foam could be selected to have a compliance that would provide multiple resonant frequencies in the system, therefore broadening the low frequency band of sound produced. A spring device has also been contemplated for compliant material 601.

Figure 7:
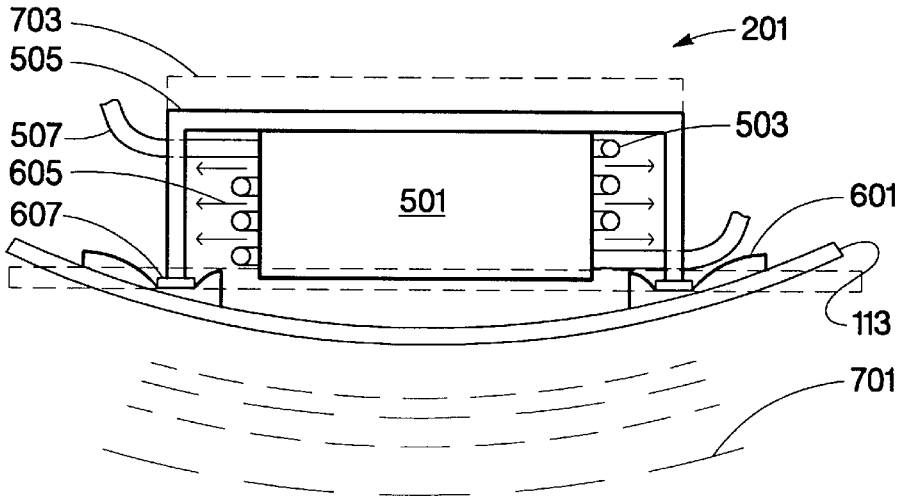
FIG. 7 is a cross-sectional view of the transducer of FIG. 5 in an actuated position.

FIG. 7 is an additional cross-sectional view of FIG. 5 illustrating the preferred embodiment of transducer 201 in an exaggerated deflected state due to one resonant mode of the system when alternating current is applied to coils 503. Phantom lines 703 indicate the resting position of transducer 201—this state is also illustrated in FIG. 6. Sound waves 701 depicts the low frequency sound emanating from electronic device shell 113.

Figure 8:
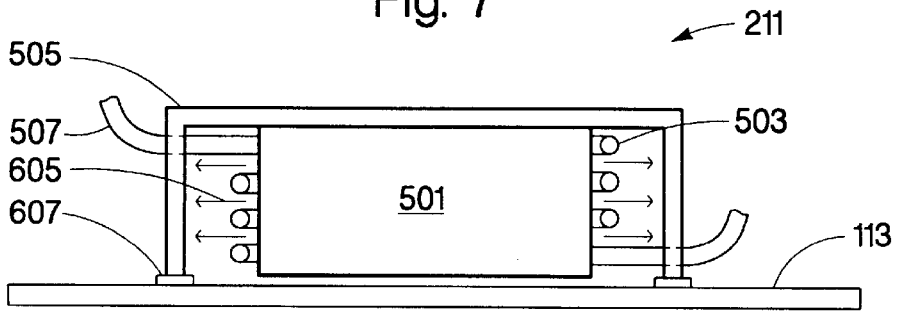
FIG. 8 is an alternate embodiment of the transducer of the invention.

FIG. 8 shows transducer 211 of an alternate embodiment. In this embodiment, can 505 is affixed directly to electronic device shell 113 without the use of compliant material 601 (FIG. 6).

Figure 9:
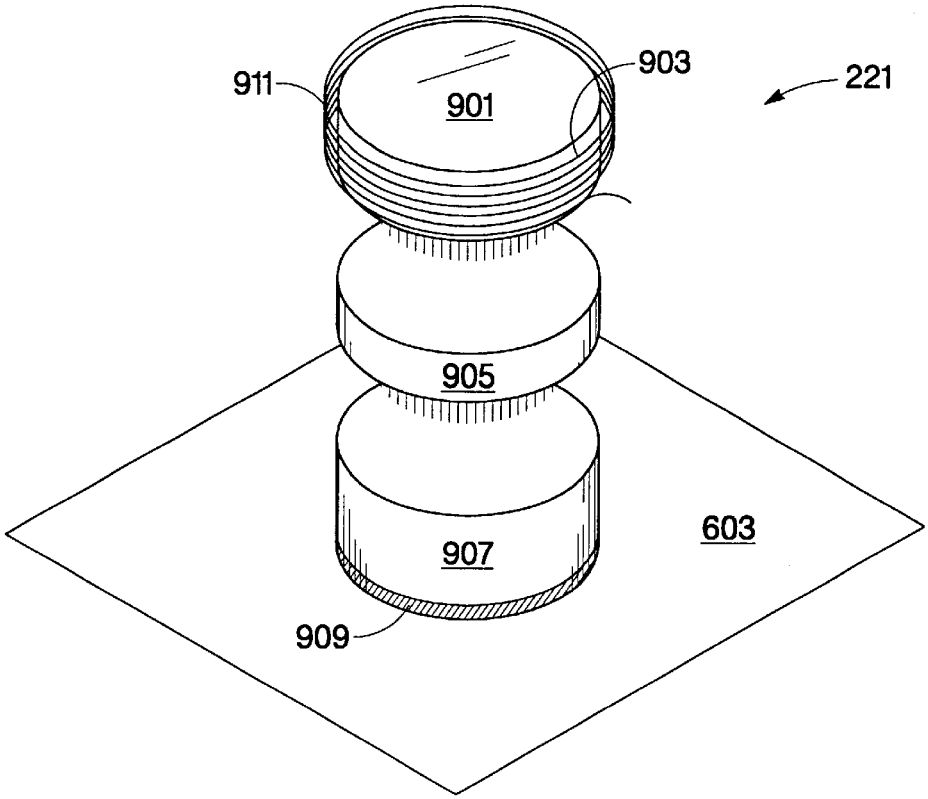
FIG. 9 is another alternate embodiment of the transducer of the invention.

FIG. 9 illustrates transducer 221 of another alternate embodiment utilizing permanent magnet 907 affixed to electronic device shell 113 by adhesive layer 909. Ferrite core 901 is wound with alternate current carrying coils 903 and is layered above permanent magnet 907 with compliant material 905 interposed between and adhered to both permanent magnet 907 and ferrite core 901 in the layered configuration shown. A low frequency audio signal is applied to control circuitry interconnect 911 switching the polarity of the magnetic poles generated at the ends of ferrite core 901 with the changing polarity of the alternating current applied. Ferrite core 901 is attracted to permanent magnet 907 when electromagnetic field polarities are dissimilar. Ferrite core 901 is repulsed away from permanent magnet 907 when electromagnetic field polarities are like. This alternation of field polarity of the magnetic poles generated at the ends of ferrite core 901 will create movement towards and away from permanent magnet 907, inducing a vibration in electronic device shell 113. As explained previously, electronic device shell 113 will then function as a speaker.

Figure 10:
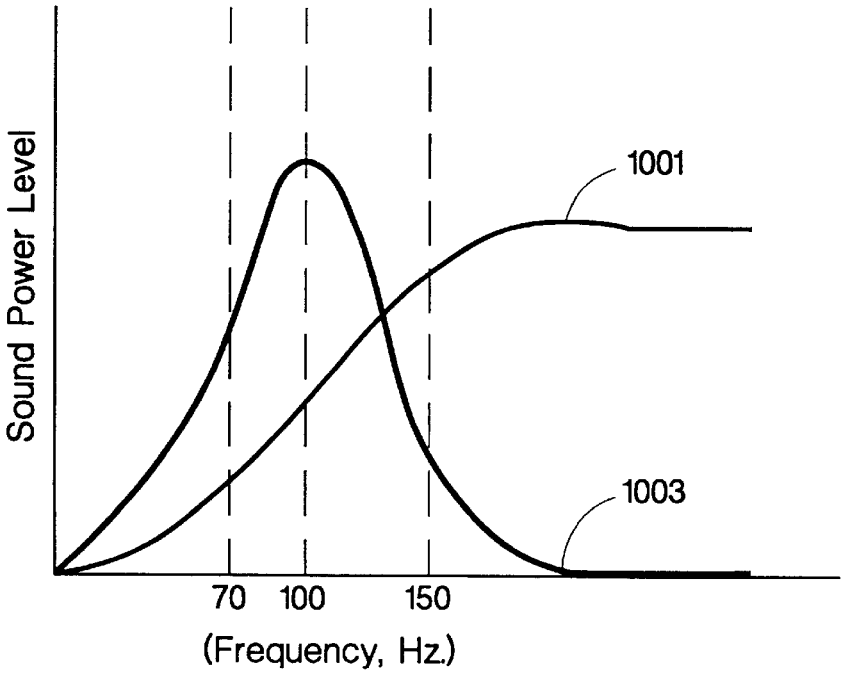
FIG. 10 is a frequency response plot.

FIG. 10 is a frequency response plot illustrating the existing speaker frequency response 1001 and filtered electronic device shell frequency response 1003. The audio spectrum in electronic device 101 is enhanced by adding the lower frequencies developed with the vibration of transducer 201 (FIG. 2) and electronic device shell 113 (FIG. 6) to the mid-range and high frequencies output from the existing speakers 115 (FIG. 1).

Figure 11:
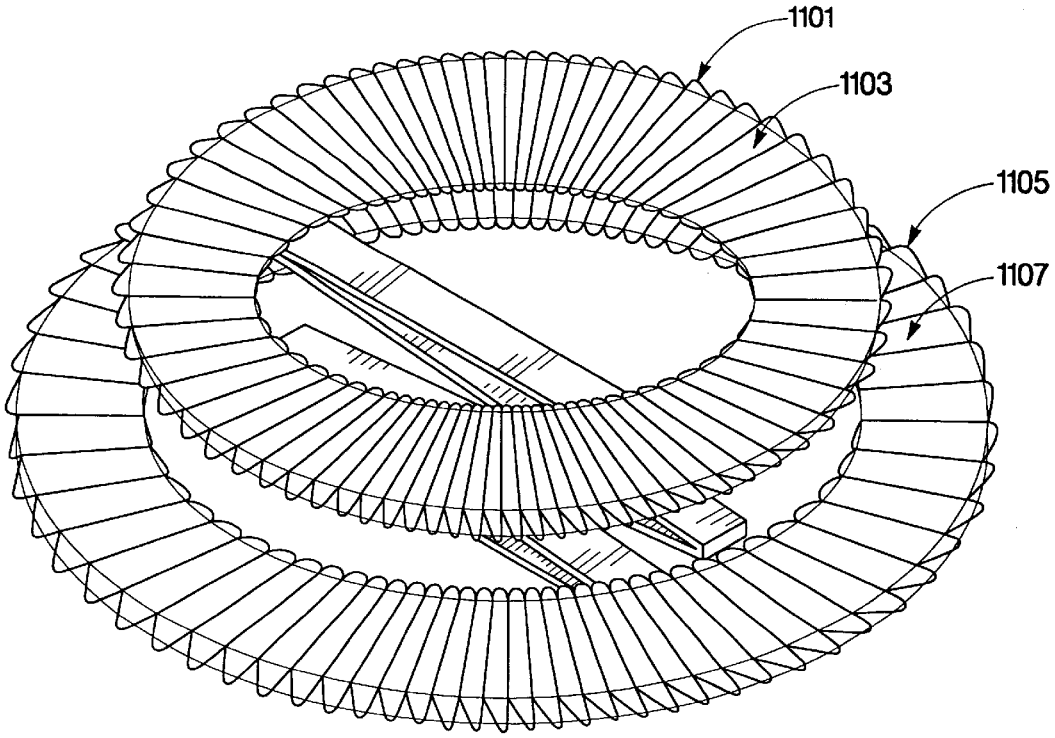
FIG. 11 is another alternate embodiment of the transducer of the invention.

FIG. 11 shows transducer 231 utilizing two ferrite torroids. Stationary torroid 1107 is wound with constant current carrying coils 803. Semi-stationary torroid 1105 is wound with alternate current carrying coils 1101.

Figure 12:
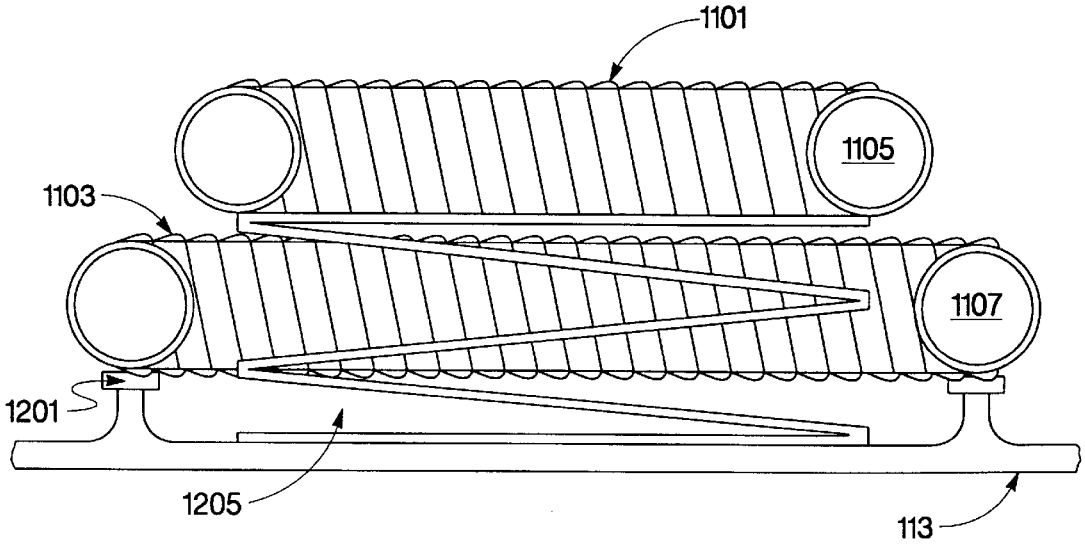
FIG. 12 is a cross-sectional view of the alternate embodiment transducer of FIG. 11.

FIG. 12 is a center cross-sectional view of FIG. 11. Stationary torroid 1107 is shown affixed to electronic device shell 113 with a layer of adhesive 1201 interposed between. Semi-stationary torroid 1105 is shown attached to compliant member 1205, which is attached to electronic device shell 1203 on the opposite end, maintaining a distance above stationary torroid 1107. A low frequency audio signal is applied to coils 1101 creating electromagnetic fields that alternately change directions with the current. The electromagnetic field established with constant current coils 1103 will attract inner ferrite core 1105 when the fields of the two coils are opposing and will repel inner ferrite core 1105 when fields are like, creating force and motion on compliant member 1205 and ultimately vibrating electronic device shell 113.

The invention will accomplish the addition of low frequency bass sounds in an electronic device that has been unattainable with existing speakers due to size restrictions in ever-shrinking electronics. This invention will enhance the audio spectrum by adding in the lower frequencies not only audibly but by physical feel created by the vibration of the electronic device shell.

What is claimed is:

1. An electronic device comprising:

a shell having an interior, an exterior and a resonant frequency;

a transducer located in said interior of said shell, said transducer comprising:

a first ferrite torroid affixed to said shell, first coils wound around said first ferrite torroid, a compliant material having a first end and a second end, said first end affixed to said shell and protruding through the center of said first ferrite torroid, a second ferrite torroid of a lesser size than said first ferrite torroid affixed to said second end of said compliant material thereby elevating said second ferrite torroid above said first ferrite torroid, and second coils wound around said second ferrite torroid;

control circuitry operatively coupled to said transducer, said control circuitry capable of sending a low frequency audio signal to said transducer;

said transducer causing said shell to vibrate around the resonant frequency of said shell, responsive to said control circuitry sending said low frequency signal; and wherein a low frequency sound is produced by the vibration of said shell.

2. The electronic device of claim 1, wherein said compliant material is a spring.

3. The electronic device of claim 1, wherein said transducer creates an electromagnetic field by an alternating current through a constant current field.

4. The electronic device of claim 1, further comprising:

at least one additional transducer causing said shell to vibrate around the resonant frequency of said shell, responsive to said control circuitry sending said low frequency signal; and wherein a low frequency sound is produced by the vibration of said shell.

5. The electronic device of claim 4 wherein the at least one additional transducer has a different low frequency response than said transducer.

6. The electronic device of claim 4, wherein the at least one additional transducer has the same low frequency response as said transducer.

7. The electronic device of claim 4, further comprising:

a first low pass filter electrically connected between said control circuitry and said transducer; and a second low pass filter electrically connected between said control circuitry and said at least one additional transducer;

wherein the low frequency sound frequency response is widened.

8. A method for producing sound in an electronic device, said electronic device comprising a shell, a transducer, and control circuitry, said shell having an interior, exterior, and resonant frequency, said transducer located in said interior of said shell, said method comprising the steps of:

applying a constant current to a first set of coils wound around a stationary ferrite torroid in said transducer;

transmitting a low frequency signal to a second set of coils wound around a semi-stationary ferrite torroid in said transducer from said control circuitry; and said transducer vibrating said shell around the resonant frequency of said shell, wherein a low frequency sound is produced by the vibration of said shell.

* * * * *